US005676774A

United States Patent [19]

Setzer et al.

[11] Patent Number: 5,676,774

[45] Date of Patent: Oct. 14, 1997

[54] MAGNESIUM ALLOY AS AN ALUMINUM HARDENER

[75] Inventors: William C. Setzer, Evansville, Ind.; Richard J. Malliris; David K. Young, both of Henderson, Ky.; Francis P. Koch, Tomales, Calif.

[73] Assignee: KB Alloys, Inc., Robards, Ky.

[21] Appl. No.: 467,771

[22] Filed: Jun. 6, 1995

Related U.S. Application Data

[63] Continuation-in-part of Ser. No. 386,698, Feb. 10, 1995.

[51] Int. Cl.[6] ..... C21D 1/09

[52] U.S. Cl. ..... 148/538; 148/549; 148/666

[58] Field of Search ..... 148/538, 549, 148/666; 420/407

[56] References Cited

U.S. PATENT DOCUMENTS 2,362,147 11/1944 Mondolfo ..... 420/407
5,248,477 9/1993 Green et al. ..... 420/590

FOREIGN PATENT DOCUMENTS 1727403 11/1994 Russian Federation ..... 148/420

OTHER PUBLICATIONS

Orive, J. Villate, "Vacuum Degasification of Light and Semilight Alloys", Rev. Met. (Madrid) 1972, 8(4), Abstract.

*Primary Examiner*—Sikyin Ip
*Attorney, Agent, or Firm*—Bachman & LaPointe, P.C.

[57] ABSTRACT

A process for producing a magnesium alloy aluminum hardener comprises the steps of providing magnesium alloy scrap, wherein the scrap comprises aluminum present in a range of 1–10 wt. % based on the weight of the scrap and at least one of zinc present in a range of 0.1–3 wt. % based on the weight of the scrap and manganese present in a range of 0.1–3 wt. % based on the weight of the scrap, wherein a remaining portion of the scrap comprises magnesium; providing molten aluminum; and adding the scrap to the molten aluminum until the hardener is produced having a magnesium content in a range of 64–72 wt. % based on the weight of the hardener, with a remaining portion of the hardener comprising aluminum and at least one of zinc and manganese.

26 Claims, 3 Drawing Sheets

MAGNESIUM ALLOY AS AN ALUMINUM HARDENER

CROSS-REFERENCE TO RELATED APPLICATION

This application is a Continuation-In-Part of U.S. patent application Ser. No. 08/386,698, filed Feb. 10, 1995.

BACKGROUND OF THE INVENTION

This invention relates to hardeners, and more particularly, to a magnesium based alloy used as an aluminum hardener.

Aluminum metal alloys are highly desirable materials for use in construction, manufacturing processes and structural devices. Aluminum alloys are particularly desirable because of their light weight and strength. However, one draw back of pure aluminum is its hardness. That is, pure aluminum is much softer than metals such as iron and steel, and thus, tends to be more easily damaged. Pure aluminum's mechanical and physical properties, however, can be enhanced by using alloying elements. These alloying elements are commonly referred to as hardeners.

Aluminum based master alloys which contain hardener elements in high concentrations, provide a convenient and economical way to supplement aluminum to achieve desired properties. Generally, these master alloys readily melt when alloyed into pure aluminum, which minimizes dross formation. Because of this, lower furnace temperatures can be used which reduces hydrogen solubility, energy consumption and prolongs furnace life. Aluminum hardeners are available on the market which use magnesium as the hardening element and which include the magnesium in different percentages based on the weight percent of the alloy. However, the current aluminum hardeners which are available, include some unappealing physical properties.

The benefit of using hardener alloys can be seen by analyzing the results when using pure magnesium to strengthen aluminum. Typically, when magnesium is added to aluminum in its pure form, the pure magnesium cannot be readily alloyed because of several problems. Firstly, the melting point of pure aluminum is 1220° F., and because the melting point of pure magnesium is 1202° F., even with some super heat in the aluminum, there is very little driving force to melt pure magnesium quickly in aluminum without raising it to a high temperature. Secondly, magnesium is less dense than aluminum and as a result, magnesium tends to float high in the aluminum, exposing the magnesium to oxygen and possibly burning. Such loss to oxidation lowers the recovery of magnesium. Thirdly, because pure magnesium takes longer to melt, time becomes a factor, thus resulting in extended furnace cycles and resulting in increased oxidation even after the magnesium has been placed into solution. The alloys available on the market deal with these problems but only to a limited degree.

Three aluminum master alloys are presently being produced: 10% magnesium, 25% magnesium and 50% magnesium-aluminum alloys. The 10% and 25% magnesium alloys are not cost effective for several reasons. The main reason is that they are dilute so they require large additions in order to achieve the required magnesium level. On a unit magnesium addition basis, it is very difficult to produce material which can compete with higher magnesium level products, even when assuming high efficiencies and rapid dissolution rates. This material is also susceptible to shrinkage cavities which can be extremely hazardous if they are exposed to moisture.

A 50% magnesium-aluminum alloy hardener is more cost effective when compared to the 10% and 25% product.

However, it does have the disadvantage that the material is extremely brittle because it is 100% intermetallic having no phase with any degree of ductility and cannot be produced in a solid ingot or waffle form without extreme process control consideration. It is also so brittle as to be very susceptible to in transit breakage. Also the 50% magnesium product is considered a flammable solid when in powder form and due to its brittle nature, fines may be generated during production and transit. Since these fines are flammable and can rapidly oxidize, they pose an explosion safety hazard. Further, as with high magnesium alloys, the 50% alloy material will burn intensely when water is added. There is a chemical reaction which takes place between the magnesium and water which exothermally forms magnesium oxide and concurrently releases hydrogen, further intensifying the flame. An advantage of the 50% magnesium alloy over the 25% and 10% alloy is that the melting point is relative low, at 864° F., therefore not requiring a relatively large driving force for placing the alloy into solution.

For both the 25% and 50% magnesium alloys, typical magnesium recoveries exists only at 90–93%, the higher values being achieved by the 25% magnesium due to the fact that it is not brittle. As is obvious from this range, consistency in determining recoveries is limited and determined to a great extent by variations in the manufacturing process for the alloy.

Magnesium aluminum alloys are also used for purposes different than hardening pure aluminum. The prior art does disclose a magnesium aluminum alloy having a magnesium content of 72–85% magnesium based on the weight percent of the alloy. This alloy is found in U.S. Pat. No. 3,505,063 wherein a method is disclosed for condensing magnesium vapors by contacting the vapors with an aluminum base alloy at a temperature below about 600° C. The alloy preferably contains 75% aluminum and 25% magnesium before condensation and 72–85% magnesium after condensation of the vapors.

There exists, therefore, a need for a more concentrated hardener and a process for producing the hardener which comprises a magnesium based alloy used for hardening aluminum, wherein the alloy does not display safety hazards, excessive addition rates, excessive oxidation, extreme brittleness and which is cost efficient.

SUMMARY OF THE INVENTION

The primary object of this invention is to provide a process for forming a magnesium alloy for use in hardening pure aluminum.

Another object of this invention is to provide a magnesium alloy having a relatively low melting point for rapid dissolution in molten aluminum.

Still another object of this invention is to provide a process for producing a magnesium alloy for hardening aluminum in an economical fashion.

Still another object of this invention is to provide a magnesium alloy which is not particularly subject to oxidation and burning due to its relatively low melting point and rapid dissolution rate.

And still another object of this invention is to provide a magnesium alloy for use in hardening aluminum which provides substantially higher magnesium recovery when added to aluminum, relative to currently available products.

And yet another object of this invention is to provide a process for producing a magnesium alloy for use in aluminum hardening which provides magnesium recovery approaching 100% and is more consistent in its recovery under a broader range of operating conditions by the manufacturer of aluminum based alloys.

The foregoing objects are obtained by the process for forming a magnesium alloy aluminum hardener of the instant invention. A process for producing a magnesium alloy aluminum hardener comprises the steps of providing magnesium alloy scrap, wherein the scrap comprises aluminum present in a range of 1–10 wt. % based on the weight of the scrap and at least one of zinc present in a range of 0.1–3 wt. % based on the weight of the scrap and manganese present in a range of 0.1–3 wt. % based on the weight of the scrap, wherein a remaining portion of the scrap comprises magnesium; providing molten aluminum; and adding the scrap to the molten aluminum until the hardener is produced having a magnesium content in a range of 64–72 wt. % based on the weight of the hardener, with a remaining portion of the hardener comprising aluminum and at least one of zinc and manganese.

The details of the present invention are set out in the following description and drawings wherein like reference characters depict like elements.

DETAILED DESCRIPTION OF THE PREFERRED EMBODIMENT

The alloy of the present invention comprises magnesium in the range of 64–72 wt. %, and preferably 68–72 wt. %, based on the weight of the alloy with the remaining portion comprising aluminum. The alloy preferably exhibits a melting point ranging from 819° F. to 910° F. The concentration of magnesium in the alloy preferably forms a eutectic or quasieutectic composition having a 64.9–84.5% by weight range of intermetallic MgAl, a reduced microporosity, and a solidification range approximately 437° C.–449° C. at 64 wt. % and approximately 437°–487° C. at 72 wt. %. Accordingly, the 64–72 wt. % alloy solidifies over ranges having a temperature span of 12°–50° C. In one particular embodiment, the magnesium is present at 70 wt. % based on the weight of the alloy and has a melting point of approximately 887° F. and 69–70% particularly 69.8% of intermetallic MgAl. Due in part to the percentage of MgAl intermetallic, the alloy of the present invention including magnesium in the range of 64–72 wt. %, and preferably 68–72 wt. %, and particularly 70 wt. % is significantly more ductile than the magnesium alloys of the prior art, i.e. specifically the 25 wt. % and 50 wt. % magnesium alloys.

Figure 1:
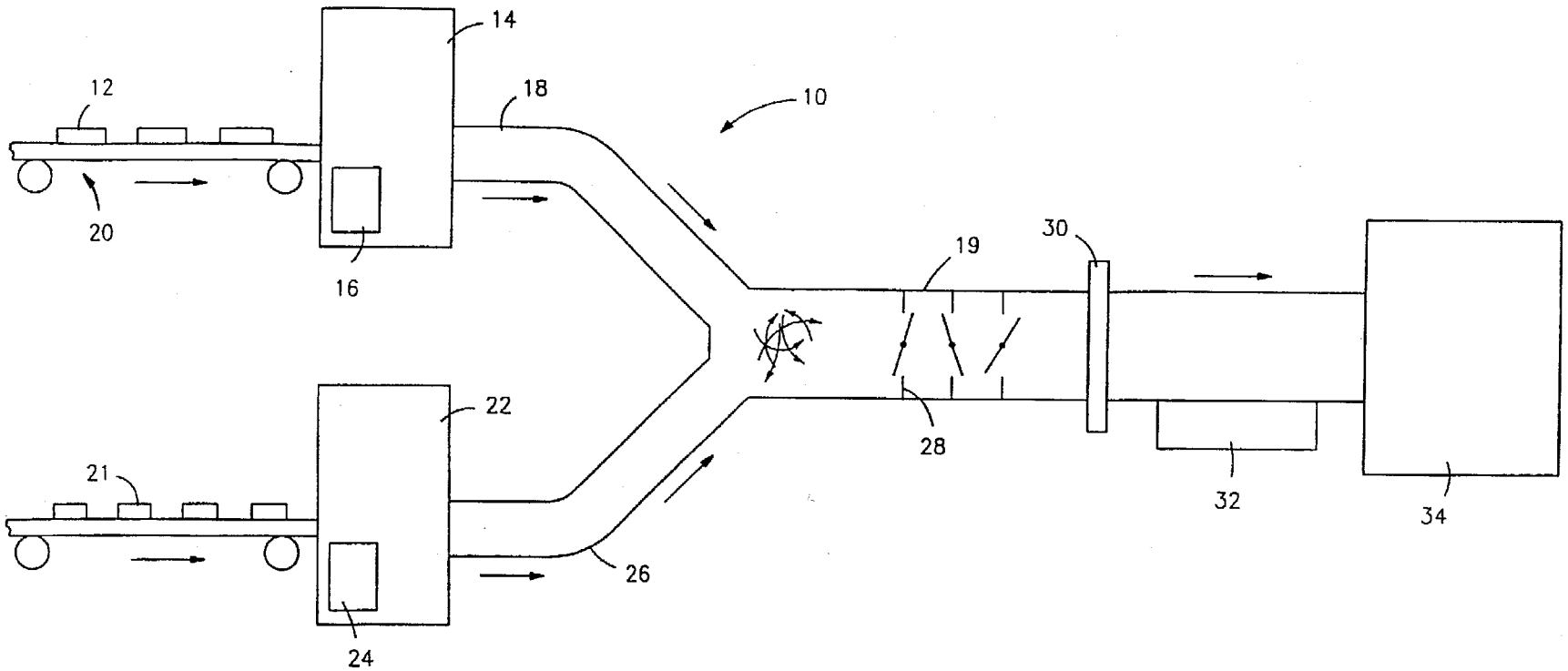
FIG. 1 is a schematic diagram of the process disclosed herein for hardening aluminum via the magnesium alloy.

Referring now to the drawings in detail there is shown in FIG. 1 a schematic view of a process of the instant invention for producing a 64–72 wt. %, and preferably 68–72 wt. %, and particularly 70 wt. % magnesium alloy of the present invention for hardening pure aluminum, designated generally as 10.

At the beginning of process 10, magnesium metal in any structure or form, such as ingots, sows or bars 12 are conveyed into furnace 14, if a source of molten magnesium is not otherwise available. Within furnace 14, metal bars 12 are melted to a molten state. Accordingly, furnace 14 must be raised to a temperature in excess of the melting point for melting bars 12. The temperature raised to should be high enough to efficiently melt the magnesium metal at a rate which is compatible to the rate in which the solid metal is added and the molten metal is extracted. When the magnesium metal bars 12 are transformed into a molten state, the molten magnesium metal is preferably syphoned or pumped via pump 16 into piping 18. The magnesium melt is directed to a conveyance container preferably in the form of a larger pipe or higher metal velocity pipe 19 which acts as a mixing vessel wherein the molten magnesium is mixed with molten aluminum. A conveying system 20 is preferably used for continually providing furnace 14 with magnesium metal bars if molten magnesium is not otherwise available.

If furnace 14 is open to the atmosphere, magnesium oxide may be generated during the melting of the pure magnesium bars. A manner for overcoming this problem is to inert the surface of the magnesium melt. This can be accomplished in several ways. A closed system can be designed which has the capacity to be purged with air and an inert gas, preferably at least one of argon, nitrogen, $CO_2$ and $SF_6$. It is important that the atmosphere not be made completely inert so as to minimize explosion potential by preventing instantaneous spontaneous oxidation upon exposure to air. Accordingly, some air is preferably always present in the closed system.

Another way of reducing the generation of oxide during the melting process, would be to add an inert floating molten salt cover to the melt. Commercial salts are available which contain Mg $Cl_2$ specifically for this purpose. Because the density of the magnesium alloy of this invention is higher than the density of pure magnesium, there is better separation of the low density salt flux from the melt. Accordingly, the salt flux tends to segregate to the top of the melt much more rapidly thereby assuring that the melt is not contaminated with the salt flux and that prevention of oxidation takes place much more securely. Still another way by which oxidation can be minimized is by adding beryllium to the melt. Specifically, only two parts per million may be used in order to minimize oxidation. This can be accomplished by adding an aluminum master alloy hardener containing 3–5% beryllium when the melt exceeds 1200° F. Accordingly, when the alloy is used for hardening aluminum, only a very small fractional part per million of beryllium is present in the final material.

Similar to the addition of magnesium as described above, if a source of molten aluminum is not available, aluminum bars 21 are conveyed into a furnace 22 wherein the aluminum bars are melted. A pump 24 or syphon is used to move the molten aluminum into pipe 26 through which the molten aluminum is directed to conveyance container 19 such as the large or high velocity pipe. Accordingly, preferably both the magnesium and aluminum are directed to pipe 19 through piping 18 and 26, respectively. At the point of combination, turbulence within pipe 19, as indicated by the arrows of FIG. 1, should be sufficient to mix the materials. However, if the turbulence is not sufficient, baffles 28 can be provided upstream in pipe 19 to provide for more mixing. Upstream or downstream of the mixing point, a filter 30 can be included to remove aluminum and/or magnesium oxide that was previously present or generated during the melting or holding process.

In order to properly cast the alloy, the alloy melt should have a temperature below 970° F. Because the magnesium and aluminum metal is melted at temperatures ranging from approximately 1200° to 1300° F., the melt preferably is cooled prior to casting. Accordingly, a heat exchanger 32 is preferably provided at the outlet end of pipe 19 so that heat is extracted from the melt until the melt acquires a temperature of less than 970° F. The alloy is then pumped into mold 34 where the alloy is preferably slow cooled and solidified, depending on the mold, into at least one of sows, waffle ingots, notched ingots, broken ingots, direct chill slab or billet ingots, T-bar, flake, buttons and rods. In any of these forms, the alloy is used for hardening aluminum.

Prior to the 64–72 wt. %, and preferably 68–72 wt. %, and particularly 70 wt. % magnesium alloy, a concern with magnesium alloys was the formation of surface connected shrinkage cavities therein which could entrap water leading to safety problems when used as a hardener. However, with the 64–72 wt. %, preferably 68–72 wt. % and particularly the 70 wt. % magnesium alloy, the formation of such surface connected cavities are controlled by mold design, mold temperature, exposed surface temperature, and melt temperature. While it is, of course, desirable that no cavities be present in the castings of the alloy of the present invention, if cavities are present, they are typically totally encapsulated so that moisture cannot enter the solidified product. Accordingly, these safety problems are averted. However, as discussed below, precautions may still be taken by cracking the alloy sows prior to use.

To make minor magnesium chemistry adjustments to a magnesium alloy melt prior to casting, it is preferable that additional small magnesium or aluminum solids be added thereto. It is also preferable to use magnesium or aluminum structures or solids such as waffles, buttons, or shot. It is also possible to use 64–72 wt. %, preferably 68–72 wt. %, and particularly 70 wt. % alloy versions of these structures for chemistry adjustments, for they dissolve rapidly with little magnesium loss because the magnesium alloy has a higher density than pure magnesium which causes it to sit lower in the melt. Once submerged in the melt, they dissolve rapidly and do not float back to the surface.

Figure 2:
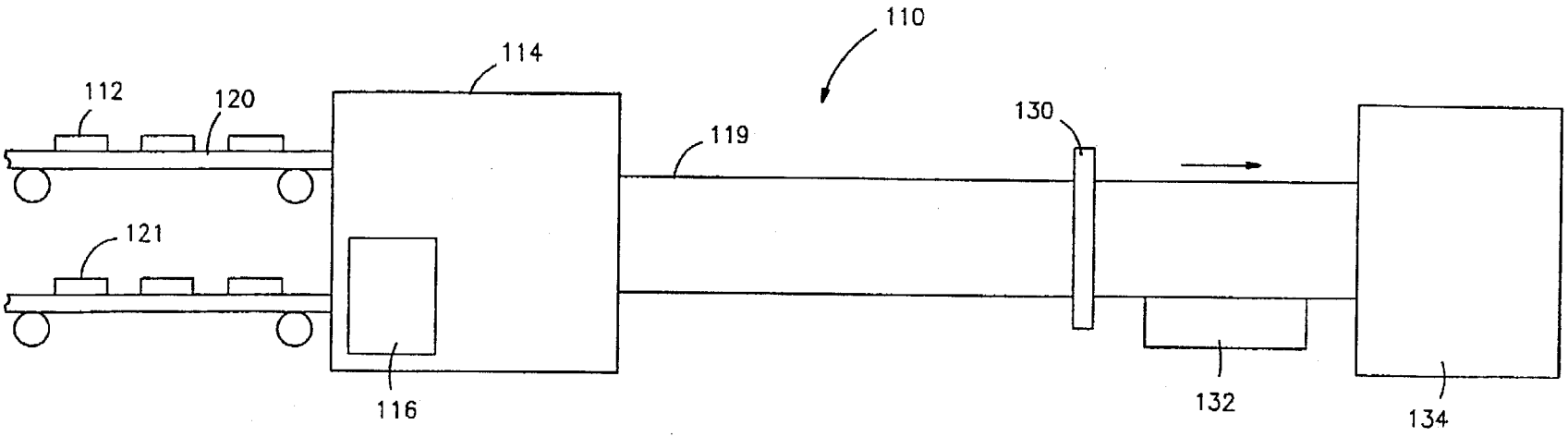
FIG. 2 is a schematic diagram of another embodiment of the process in accordance with the principles of the present invention.

As an alternative to the above, either or both the aluminum and magnesium can be melted and combined in a single furnace as shown in process 110 of FIG. 2. With this alternative, the furnace 114 will preferably be an induction furnace. By this process, the threat of oxidation is greater and therefore several preparatory steps with relation to aluminum metal 121 and magnesium metal solids 112 should be taken.

Melting magnesium bars 112 by mixture into molten aluminum can take an extended amount of time wherein the magnesium will tend to oxidize extensively. One step which can be taken to preclude such oxidation is preheating the aluminum. That is, if the aluminum contains a high amount of super heat, a larger portion of the solid magnesium metal can be added at a quicker rate without having to worry about the metal temperature dropping below the melting point. In addition, the magnesium will also melt faster since there is a larger temperature gradient between the super heated aluminum and the temperature of the magnesium.

An additional step for improving through put of the magnesium into the aluminum, in addition to or separate from super heating the aluminum, is preheating the magnesium. However, in order to prevent potentially large problems with the burning of magnesium, it is preferable to preheat the magnesium bars individually and with indirect fire to prevent burning. By individual heating, if a problem with burning occurs, only one bar or the like is potentially lost. The use of direct fire for preheating is not suggested in that even with a temperature as low as 500° F., direct fire can lead to magnesium fires.

In accordance with preheating the magnesium bars as rapidly as possible and with indirect heat, it is preferable to place the bars on a conveyor system 120 which has a rapid indirect heating ability. The conveyors can be set up at a speed such that the magnesium is added at a constant rate to the furnace. This will produce less variability in the process and reduce cycle time.

Similar to the above embodiment of FIG. 1, once the magnesium and aluminum alloy melt is obtained, it is necessary to reduce the temperature of the melt to below 970° F. for casting while minimizing magnesium burning. That is, casting at higher temperatures in an oxidizing atmosphere may cause magnesium to burn spontaneously resulting in heavy metal losses. Accordingly, the alloy melt, having reached 1200° F. should be cooled to below 970° F. prior to casting and prior to being syphoned or pumped via pump 116 through piping 119 to mold 134. Without assistance, an extended amount of time is needed to cool the alloy melt. In order to increase the rate with which the melt cools, pure magnesium metal bars or the like are preferably added to the alloy melt until the final temperature of the molten alloy is below 970° F. Since this temperature is significantly below the melting point of magnesium, less than 1–2% of the magnesium will dissolve. Consequently, this portion of magnesium is now super heated to below 970° F. in the furnace, reducing the amount of time and heat needed to melt the magnesium for the next run of melting the aluminum and magnesium, while providing the melt with the desired casting temperature.

As with the first embodiment, another option in quenching the melt, is to run the melt, at 1200° F., through a heat exchanger 132 for reducing the temperature to an appropriate level for casting. Also, a filter 130 can be used downstream of furnace 114 to remove oxides from the melt.

After the magnesium and aluminum melt is quenched, i.e. reduced to a temperature below 970° F., it is cast into mold 134 and then preferably slow cooled. After casting, super heated aluminum is added to the furnace and the remaining solid magnesium which has been preheated to below 970° F., is heated under full power, such that enough energy is added to the melt to melt the magnesium and stabilize the temperature around 1200° F. Additional magnesium and/or aluminum can be added to this melt for providing the desired 64–72 wt. %, preferably 68–72 wt. %, and particularly 70 wt. % magnesium chemical makeup. Similar to the above, in order to prepare the melt for casting, immediately before casting, additional magnesium bars may be added to the melt for dropping the temperature below 970° F. for casting. This cycle is preferably continuously repeated.

As an alternative to using a furnace for mixing magnesium and molten aluminum, as described above for FIGS. 1 and 2, the magnesium and aluminum may be melted separately and provided for mixing in metered amounts. When the metered amounts of molten magnesium and molten aluminum are mixed, the hardener with the desired component percentages is acquired. The particular method used for acquiring the metered amounts is not critical. Accordingly, upon mixing the metered amount of molten magnesium with the metered amount of molten aluminum, the hardener having magnesium in the range 64–72 wt. %, and preferably 68–72 wt. %, and particularly 70 wt. % based on the weight of the alloy, is acquired.

A third embodiment of the process of the present invention can be described with reference to FIG. 3. In this embodiment, instead of combining slabs or the like of magnesium and aluminum into a furnace, magnesium alloy scrap is used to produce the alloy hardener in the desired composition. Two types of scrap are preferably used, i.e., an AZ series scrap containing aluminum, zinc and magnesium and an AM series scrap containing aluminum, manganese and magnesium.

The preferable ranges of the AZ series scrap include 1–10 wt. % aluminum and 0.1–3 wt. % zinc. Two types of AZ series scrap can preferably be used, i.e. AZ-61 and AZ-91, although other types can also be used depending on desired compositions. AZ-61 scrap includes approximately 6 wt. % aluminum and typically less than 1 wt. % zinc, preferably 0.4–1.5 wt. %, and particularly 0.95 wt. % zinc. AZ-91 scrap includes approximately 9 wt. % aluminum and typically less than 1 wt. % zinc, preferably 0.4–1.0 wt. % zinc, and particularly 0.7 wt. % zinc.

Two types of AM series scrap can be used, i.e. AM-50 and AM-60. The preferable ranges for the AM series scrap include 1–10 wt. % aluminum and 0.1–3 wt. % manganese, based on the weight of the scrap. AM-50 scrap includes 5 wt. % aluminum and less than 1 wt. % manganese, preferably 0.26–0.6 wt. % manganese, and particularly 0.43 wt. % manganese. AM-60 scrap includes 6 wt. % aluminum and again less than 1 wt. % manganese, preferably 0.24–0.6 wt. % manganese, and particularly 0.42 wt. % manganese.

Depending on the resulting aluminum alloy series to be formed and hardened by the use of the 64–72 wt. %, preferably 68–72 wt. %, and particularly 70 wt. % alloy hardener, either the AZ or AM or both series are used. For example, for 2000X aluminum alloys, zinc is an important element and therefore the AZ series is used. The AM series can, for example, be used for forming the 3000X and 5000X aluminum alloys since manganese is an important element and in fact, both the AM and AZ series together can be used for forming some versions of 3000X and 5000X alloys in that some versions of these alloy series includes both manganese and zinc in weight percents acquirable via the use of the AM and AZ series scrap. Accordingly, depending on the end composition of the alloy being formulated and hardened, the particular AM or AZ series scrap having the particular ranges discussed are used.

The composition of the 64–72 wt. %, preferably 68–72 wt. %, and particularly 70 wt. % alloy hardener of the present invention can be controlled by knowing the composition of the scrap used to form it and weighing the scrap prior to melting the scrap in molten aluminum. Accordingly, by knowing the composition of the scrap and the amount of scrap to be added to the molten aluminum, the desired composition of the alloy hardener can be attained. Such composition control can be used for each of the AZ and AM series and also for the combination of the AZ and AM series to formulate the desired percentages of the alloy hardener disclosed.

Figure 3:
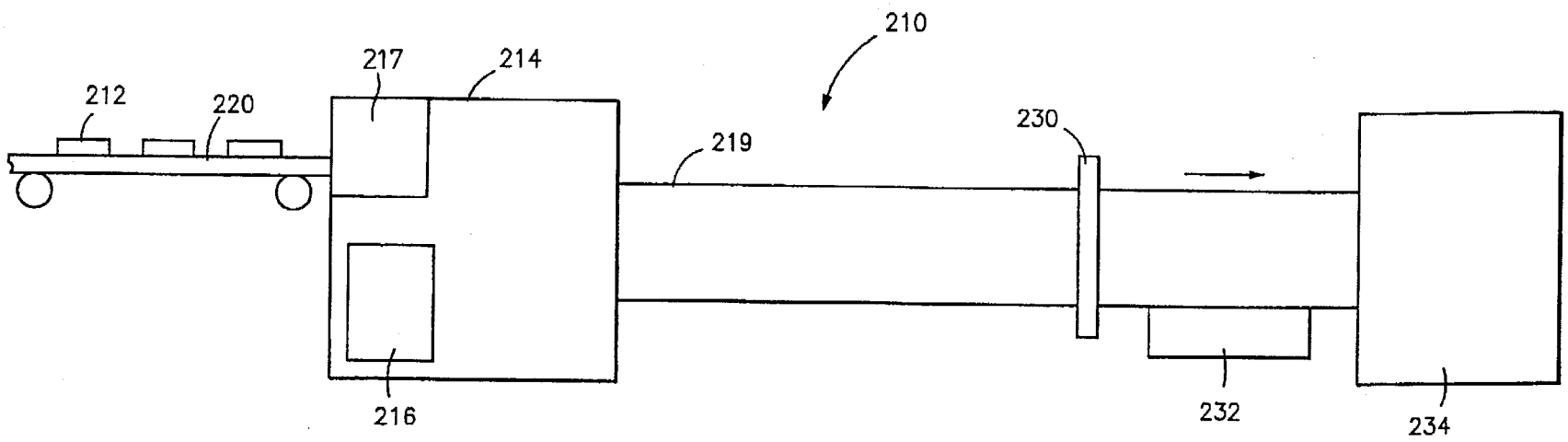
FIG. 3 is a schematic diagram of another embodiment of the process in accordance with the principles of the present invention.

With reference to FIG. 3, process 210 begins by providing a molten heel of aluminum 217 in furnace 214 wherein the molten aluminum is preferably heated to a temperature range of 1300°–1500° F. or above, and preferably 1400° F. This preheated aluminum melt is used to melt scrap 212 provided to furnace 214 in some manner, such as for example, a conveying belt 220. Scrap 212 can take a variety of forms such as, for example, in the form of loose scrap, biscuit, runners, gates and/or defective materials and as discussed above, the scrap is preferably either of the AZ or AM series. The scrap is preferably clean but this is not necessary for its processing. However, additional steps may be required if the scrap has residual oil from a process such as, for example, die casting, as discussed in more detail below. It is also preferable to inspect the scrap to insure that moisture has not gathered thereon or that the scrap is not undesirably mixed. As discussed above, prior to moving scrap 212 into furnace 214, the scrap is preweighed such that the desired composition is obtained when placed into the molten aluminum heel 217 of furnace 214.

After the above steps with reference to inspecting the scrap and the like, scrap 212 is moved into molten aluminum heel 217 of furnace 214. The heel is preferably one to two feet high relative a five foot furnace. The scrap is then melted in heel 217 wherein all the preweighed scrap is added such that the desired 64–72 wt. %, preferably 68–72 wt. % and particularly 70 wt. % hardening alloy is obtained.

In the situation where the scrap has a coating of volatile material, such as for example, oil or the like, the volatiles can be burned off above the heel of molten aluminum as it slowly feeds in. In addition, and if necessary, a small amount of flux can be used formulated from, for example, 50% MgCl and 50% NaCl in order to form a protective salt layer and prevent oxidation and burning of the scrap, which has been discussed in greater detail above with reference to the addition of pure magnesium to a melt.

One problem which may be associated with using scrap, as compared to using pure magnesium, is that with scrap there may be an unwanted $H_2$ content. Accordingly, the scrap must be degassed so as to prevent the formation of large voids in the cast hardener. Degassing can be accomplished by the infiltration of the alloy hardener with argon, chlorine, or nitrogen gas.

Accordingly, once the above steps are taken as necessary and the preweighed scrap is melted in the superheated aluminum melt heel 217, the resulting alloy hardener is pumped via pump 216 through piping 219 and filter 230 as described above for embodiments 10 and 110. Prior to casting, and as with the above embodiments, a heat exchanger 232 may be used to reduce the temperature of the alloy hardener to below 970° F. Once the temperature of the molten alloy hardener is reduced, the hardener is case into the desired forms in mold 234 and preferably slow cooled.

A specific example of the process disclosed with regard to AZ-91 scrap is as follows:

1. Molten aluminum is transferred into furnace 214 at about 1400° F., forming a 1 to 2 foot heel and is maintained at at least 1200°–1300° F. for melting scrap. Furnace 214 is an induction furnace.

2. 3400 pounds of AZ-91 scrap is added to the heel for melting in furnace 214. Based on 10% of the AZ series alloy being comprised of aluminum and zinc and the remainder magnesium, approximately 3060 pounds of magnesium will be obtained, i.e., 90% of the 3400 pounds of scrap.

3. Scrap is continually added until the correct chemistry of the desired alloy hardener is reached, wherein if necessary, additional molten aluminum can be added to the furnace to reach the desired 64–72 wt. %, and preferably 68–72 wt. %, and particularly 70 wt. % composition of the alloy hardener.

4. Once the correct chemistry is reached for the alloy hardener, the temperature of the molten alloy hardener is reduced to below 970° F. for casting.

5. The alloy hardener is cast below 970° F. into any one or number of forms including, for example, sows, ingots, buttons, slabs, and rods and preferably slow cooled.

6. Alloy hardeners which are produced with the AZ-61 scrap include zinc preferably in the range of between 0.3 and 1.0 wt. %, and particularly 0.65 wt. %, based on the weight of the alloy. Alloy hardeners which are produced with the AZ-91 scrap include zinc preferably in the range of between 0.3 and 0.7 wt. %, and particularly 0.5 wt. %, based on the weight of the alloy.

7. Steps similar to steps 1–5 may be carried out for AM series scrap. The composition of the final alloy hardeners for AM-50 scrap will typically include manganese preferably in the range of 0.2 to 0.4 wt. %, and particularly 0.3 wt. %, based on the weight of the alloy. The composition of the final alloy hardeners for AM-60 scrap will typically include manganese preferably in the range of 0.15 to 0.4 wt. %, and particularly 0.28 wt. %, based on the weight of the alloy.

In using the magnesium alloy hardener of the present invention obtained through all of the processes discussed above, because of the possibility of surface or encapsulated moisture as discussed above, prior to placing 64–72 wt. %, preferably 68–72 wt. %, and particularly 70 wt. % magnesium alloy structures into aluminum melt, for use in hardening aluminum or into the alloy melt for adjusting chemistry, the structures or sows are preferably preheated, for example, via placement at the hearth of a furnace. After placement, the sow may split due to thermal stress along lines of high stress concentration, generally breaking into two parts within two to five minutes. Such cracking will expose any possible porosity and shrinkage cavities and thereby allow surface and any other moisture which might have become incorporated into the sow due to outside storage, etc. of the ingot to be exposed and evaporated. This reduces hydrogen pick up in the melt and eliminates any potentially volatile reaction between moisture and the melt. The rapid dissolution of the 64–72 wt. %, preferably 68–72 wt. %, and particularly 70 wt. % magnesium sows reduces processing cycle time for magnesium alloys and insures high recovery due to minimal oxidation.

In order to further reduce oxidation which may be prevalent in all of the above discussed processes, when pumping or syphoning the melt through the system, pump 116 should be constructed of insoluble metals or other non-reactive and inert materials. This type of pump will not deteriorate rapidly and does not contribute either impurities or oxides to the metal. The metal which is being pumped or circulated from the bottom of the furnace and directed to the molds during casting eliminates cascading metal and prevents any impurities which are lighter than the alloy and have floated to the top, from being contained in the metal as it is being pumped.

Accordingly, the metal can be pumped immediately from the furnace to the mold without exposure to the atmosphere. Pump 116 can also be used to circulate the metal in the furnace during the making process. This minimizes the amount of chemical and temperature stratification during the making process and would decrease the cycle time for making the melt. By reducing the cycle time, there is less time for oxide generation. Additionally, by using a pump or syphon the melt can be decanted some distance off the bottom of the furnace which allows less dense particles, such as magnesium oxide and salt fluxes, to remain on the surface of the melt in the furnace and act as a protective cover while heavier particles remain in the furnace during a settling period.

One problem, however, with using a pump in such a system is the erosion of the bearing region due to loading, which occurs in this region at high temperatures. By injecting boron nitride into the bearing region, wetting of the bearing region is prevented. This increases the life of the bearing material and therefore the life of the pump.

The primary advantage of this invention is that a magnesium alloy is provided for use in hardening pure aluminum. Another advantage of this invention is that a magnesium alloy is provided having a relatively low melting point for rapid dissolution of the alloy in molten aluminum. Still another advantage of this invention is that a process for producing a magnesium alloy is provided for hardening aluminum in an economical fashion. Still another advantage of this invention is that a magnesium alloy is provided which is not particularly subject to oxidation and fire due to it relatively low melting point and rapid dissolution rate. And still another advantage of this invention is that a magnesium alloy is provided for use in hardening aluminum which provides substantially higher magnesium recovery when added to aluminum, relative to currently available products. And yet another advantage of this invention is that a process is provided for producing a magnesium alloy for use in aluminum hardening which provides magnesium recovery approaching 100%. And another advantage of the present invention is that a process is provided for hardening aluminum.

It is to be understood that the invention is not limited to the illustrations described and shown herein, which are deemed to be merely illustrative of the best modes of carrying out the invention, and which are susceptible to modification of form, size, arrangement of parts and details of operation. The invention rather is intended to encompass all such modifications which are within its spirit and scope as defined by the claims.

What is claimed is:

1. A process for producing a magnesium alloy aluminum hardener, comprising the steps of:

providing magnesium alloy scrap, wherein said scrap consists essentially of aluminum present in a range of 1–10 wt. % based on the weight of the scrap and at least one of zinc present in a range of 0.1–3 wt. % based on the weight of the scrap and manganese present in a range of 0.1–3 wt. % based on the weight of the scrap, wherein a remaining portion of the scrap consists essentially of magnesium;

providing molten aluminum; and adding said scrap to said molten aluminum until said hardener is produced having a magnesium content in a range of 68–72 wt. % based on the weight of the hardener, at least one of zinc in an amount of 0.3–1% by weight and manganese in an amount of 0.15–0.4% by weight, balance essentially aluminum, wherein said hardener includes MgAl intermetallic in the range of 64.9 to 84.5% and has a solidification range spanning 12° to 50° C.

2. The process according to claim 1, wherein said zinc is present in the magnesium alloy scrap in a range of 0.4–1.5 wt. % based on the weight of the scrap.

3. The process according to claim 1, wherein said manganese is present in the magnesium alloy scrap in a range of 0.24–0.60 wt. % based on the weight of the scrap.

4. The process according to claim 1, wherein said aluminum is present in the magnesium alloy scrap in an amount of about 6 wt. % based on the weight of the scrap.

5. The process according to claim 4, wherein said zinc is present in the magnesium alloy scrap in a range of 0.4–1.5 wt. % based on the weight of the scrap.

6. The process according to claim 1, wherein said aluminum is present in the magnesium alloy scrap in an amount of about 9 wt. % based on the weight of the scrap.

7. The process according to claim 6, wherein said zinc is present in the magnesium alloy scrap in a range of 0.40–1.0 wt. % based on the weight of the scrap.

8. The process according to claim 1, wherein said aluminum is present in the magnesium alloy scrap in the amount of about 5 wt. % based on the weight of the scrap.

9. The process according to claim 8, wherein said manganese is present in the magnesium alloy scrap in a range of 0.26–0.60 wt. % based on the weight of the scrap.

10. The process according to claim 1, wherein said aluminum is present in the magnesium alloy scrap in the amount of about 6 wt. % based on the weight of the scrap.

11. The process according to claim 10, wherein said manganese is present in the magnesium alloy scrap in a range of 0.24–0.60 wt. % based on the weight of the scrap.

12. The process according to claim 1, wherein said molten aluminum is provided in a heel of a furnace at a temperature ranging from 1300° to 1500° F.

13. The process according to claim 1, further comprising the step of reducing the temperature of said hardener to a temperature below 970° F. prior to casting.

14. The process according to claim 13, further comprising the step of slow cooling said hardener after the step of casting.

15. The process according to claim 1, wherein said scrap contains unwanted hydrogen, said process further comprising the step of degassing said scrap.

16. The process according to claim 15, wherein said step of degassing includes the step of adding at least one of argon, chlorine, and nitrogen to said scrap and said molten aluminum.

17. The process according to claim 1, wherein said hardener has a melting temperature range of 819° F. to 910° F.

18. The process according to claim 1, wherein said step of providing magnesium alloy scrap includes providing molten magnesium alloy scrap, further comprising the step of metering said molten magnesium alloy scrap and said molten aluminum for acquiring a metered amount of said molten aluminum and a metered amount of said molten magnesium alloy scrap, said step of adding further including mixing said metered amount of said molten magnesium alloy scrap and said metered amount of said molten aluminum and producing said hardener having a magnesium content in the range of 68–72 wt. % based on the weight of the hardener.

19. The process according to claim 1, including magnesium present at 70 wt. % with said intermetallic MgAl present at about 69 to 70% by weight.

20. The process according to claim 1, wherein said hardener is a eutectic or quasi-eutectic composition.

21. A process for producing an aluminum alloy, comprising the steps of:

providing a hardener alloy consisting essentially of a magnesium content in a range of 68–72 wt. % based on the weight of the hardener, with a remaining portion of said hardener consisting essentially of aluminum and at least one of zinc in an amount of 0.3–1% by weight and manganese in an amount of 0.15–4% by weight, balance essentially aluminum, wherein said hardener includes MgAl intermetallic in the range of 64.9 to 84.5% and has a solidification range spanning 12° to 50° C., wherein said hardener is a eutectic or quasi-eutectic composition; and adding said hardener to molten aluminum, thereby hardening the aluminum and obtaining high magnesium recovery.

22. The process according to claim 21, further comprising the step of producing said alloy in a 3000 series aluminum alloy via said hardener.

23. The process according to claim 21, further comprising the step of producing said alloy in at least one of a 2000 and 5000 series aluminum alloy via said hardener.

24. The process according to claim 21, wherein said hardener has a melting point range of 819° F. to 910° F.

25. The process according to claim 1, including magnesium present at 70 wt. % with said intermetallic MgAl present at about 69 to 70% by weight.

26. The process according to claim 21, wherein at a magnesium content of 72 wt. % said hardener has a solidification range of 437° C. to 487° C.

* * * * *